US005586742A

United States Patent [19]

Carter

[11] Patent Number: 5,586,742

[45] Date of Patent: Dec. 24, 1996

[54] LIGHT STANDARD APPARATUS

[76] Inventor: E. Ray Carter, 2515 N. 7th St., Phoenix, Ariz. 85006

[21] Appl. No.: 595,099

[22] Filed: Apr. 22, 1996

Related U.S. Application Data

[63] Continuation of Ser. No. 238,001, May 3, 1994.

[51] Int. Cl.[6] ..... F21V 7/00

[52] U.S. Cl. ..... 248/545; 439/92; 439/95; 174/51; 52/28; 52/40; 52/156; 52/165; 52/726.4

[58] Field of Search ..... 52/28, 40, 726.4, 52/156, 165, 297, 298; 248/156, 158, 545, 532; 174/37, 38, 45 R, 51, 78; 362/382, 331, 53.1, 414; 439/92, 95, 108, 527, 529, 611

[56] References Cited

U.S. PATENT DOCUMENTS

| | | |
|---|---|---|
| 632,966 | 9/1899 | Mullenix . |
| 1,754,601 | 4/1930 | Borden . |
| 1,764,207 | 6/1930 | Johnson . |
| 1,775,352 | 9/1930 | Mahan . |
| 1,794,467 | 3/1931 | Lucas . |
| 1,899,365 | 2/1933 | Thomas . |
| 2,260,136 | 10/1941 | Bergan . |
| 2,710,381 | 6/1955 | Monson . |
| 2,974,185 | 3/1961 | Curtiss . |
| 3,012,134 | 12/1961 | Worth . |
| 3,027,533 | 3/1962 | Monson . |
| 3,257,496 | 6/1966 | Hamilton . |
| 3,435,124 | 3/1969 | Channell . |
| 3,466,379 | 9/1969 | Lohman . |
| 3,652,779 | 3/1972 | Grinols . |
| 3,727,357 | 4/1973 | Stillman . |
| 3,752,430 | 8/1973 | Kenyon et al. . |
| 3,868,474 | 2/1975 | Bunten . |
| 3,988,870 | 11/1976 | Snavely . |
| 4,048,776 | 9/1977 | Sato . |
| 4,293,899 | 10/1981 | Sanner . |
| 4,519,657 | 5/1985 | Jensen . |
| 4,768,139 | 8/1988 | Poppenheimer . |
| 4,774,648 | 9/1988 | Kakuk et al. . |
| 4,793,111 | 12/1988 | Shewchuk . |
| 4,858,877 | 8/1989 | Carter . |
| 5,075,833 | 12/1991 | Dormand . |

OTHER PUBLICATIONS

"Near Quality Fittings" Catalog, by Neer Manufacturing Co., October 1, 1983, pp. 6–26.
"Electrical Construction Material Directory," by Underwriters Laboratories, Inc., May 1986, pp. 172–175.
"RACO Pocket Catalog," by Raco, Inc., Jan. 1990 p. D16.
"National Electrical Code," Section 250–113.
"Lighting Ideas" Catalog, pp. 155–156.
"Kichler Lighting" Catalog, page marked E00000416.
"Evening Reflections" Landscape Lighting Catalog pp. marked E00000365 & E00000377.
"Hanover Lantern" catalog selected pages.
"Amrak" brochure.
"Lighting Design" Article., Kitcheler Power Post brochure.
Various "Etcon" 4 Epco Product Literature.
Various "Midwest Plastics", Picoma, Mighty Post, Progress, Octapost product literature.
Photographs of installations at Lost Tree Village, North Palm Beach, FL. & Gainey Ranch, Scottsdale, Arizona.

*Primary Examiner*—Robert Canfield
*Attorney, Agent, or Firm*—H. Gordon Shields

[57] ABSTRACT

Light standard apparatus includes a post made of nonconductive (plastic) material topped or closed at the top by a plastic cap. A light fixture or other electrical element is secured to the cap either directly or through a bushing. A noncorrosive ground element is secured to the cap on the bushing for grounding the fixture or element to a ground conductor which extends into the post along with current conductors. The post is secured to a base, and the base is appropriately secured to a pad or to the earth. Appropriate fasteners are used to secure the base and the post in place. Earth anchors may be used, as required.

12 Claims, 4 Drawing Sheets

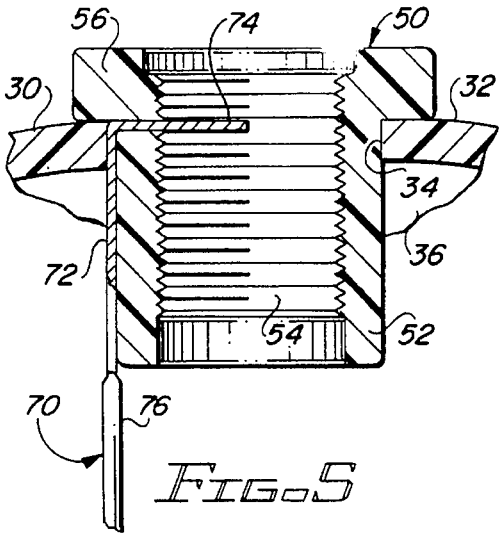
FIG. 5
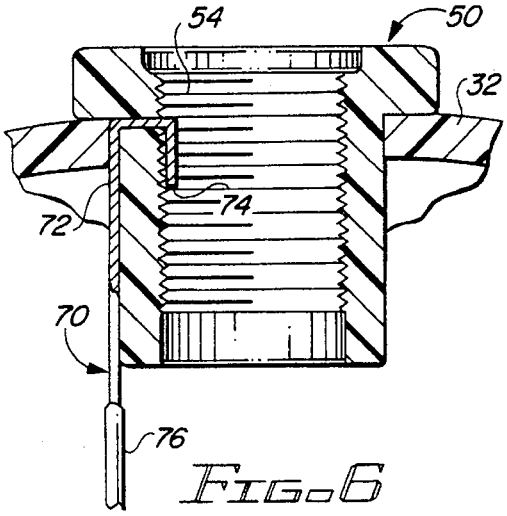
FIG. 6
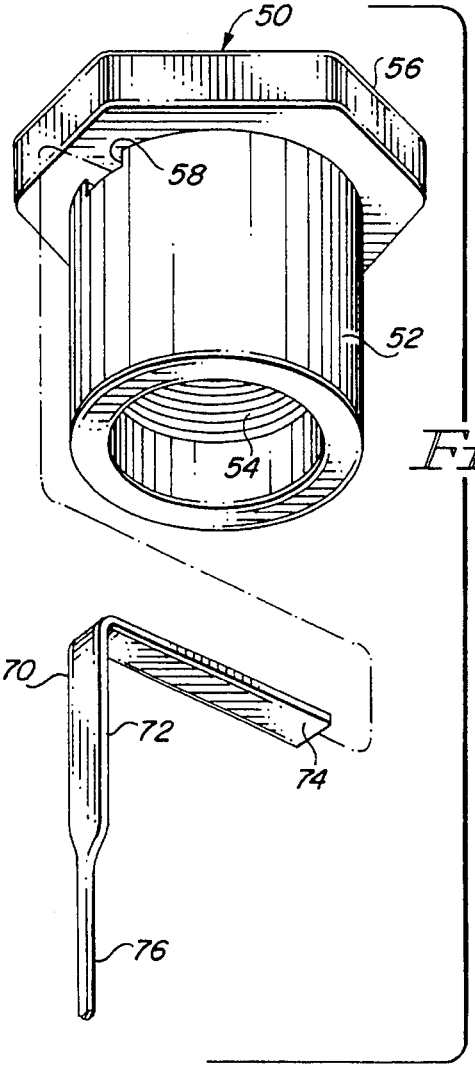
FIG. 4
FIG. 7A
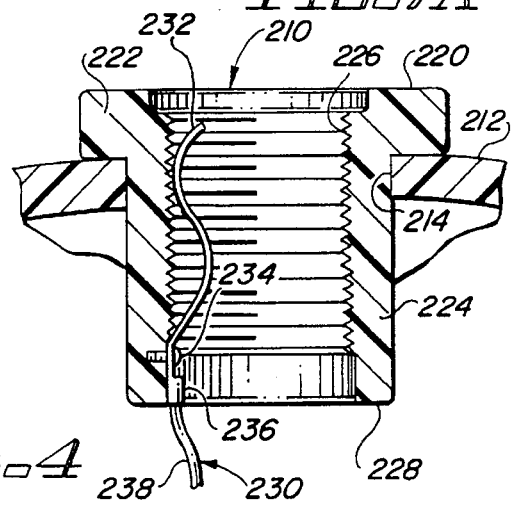
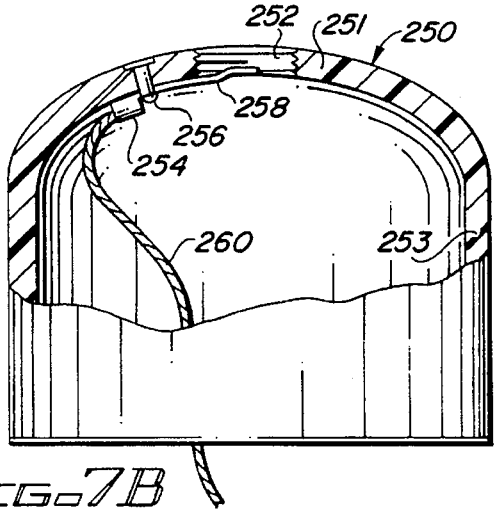
FIG. 7B

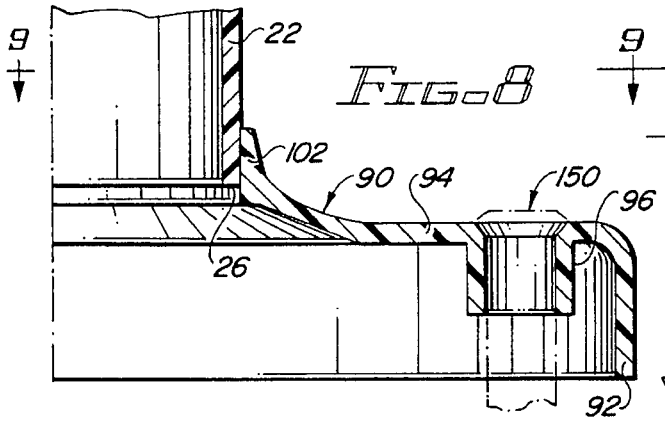
FIG. 8
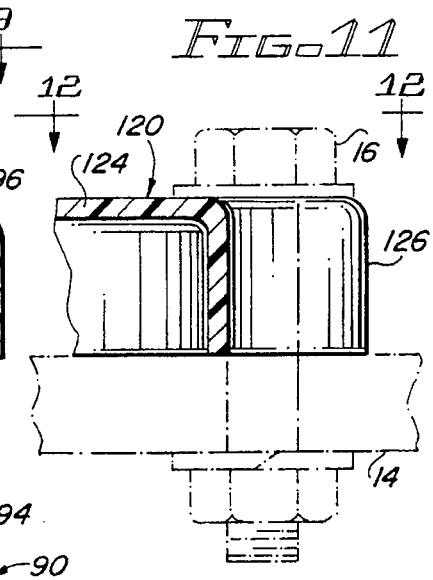
FIG. 11
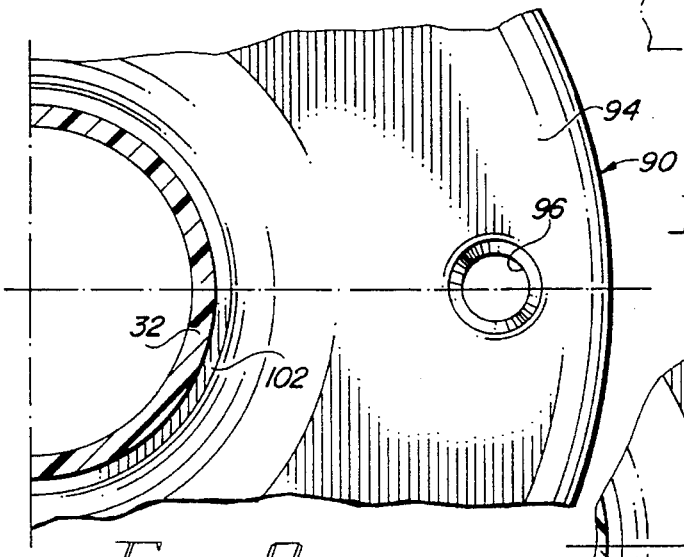
FIG. 9
FIG. 12
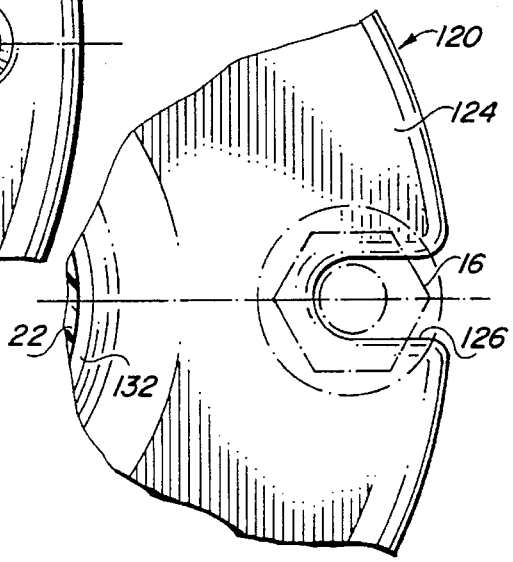
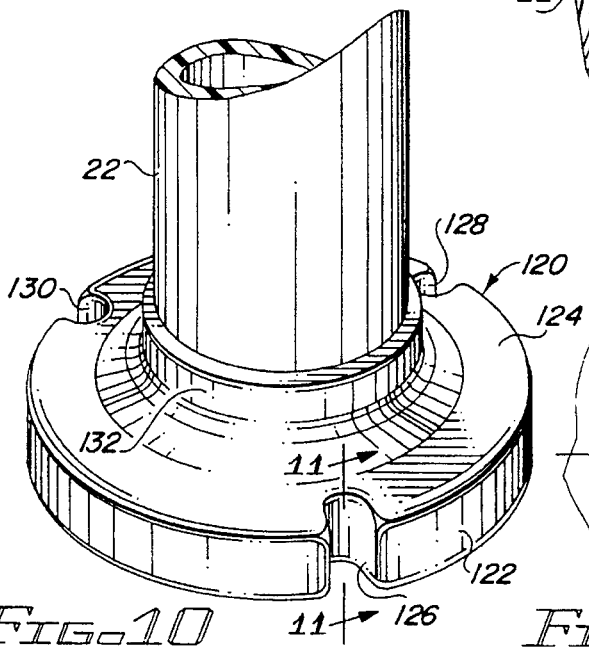
FIG. 10
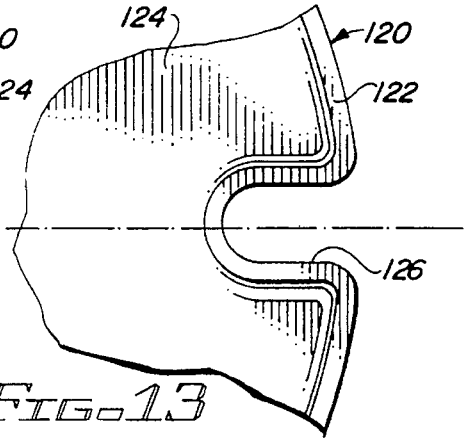
FIG. 13

LIGHT STANDARD APPARATUS

CROSS REFERENCE TO RELATED APPLICATION

This application is a Continuation application of Ser. No. 08/238,001, filed May 3, 1994.

BACKGROUND OF THE INVENTION

1. Field of the Invention

This invention relates to standards for supporting electrical fixtures and, more particularly, to nonconductive standards for receiving and supporting electrical fixtures, electrical boxes, and the like, and to anchor elements for anchoring the standard in the ground.

2. Description of the Prior Art

U.S. Pat. No. 4,858,877, the inventor of which is the inventor herein, describes light standard apparatus designed primarily for original construction in which underground conduit extends upwardly into a light standard or support element, and a light fixture is in turn secured to the light standard. The apparatus of the '877 Patent includes a nonconductive tubular element and a nonconductive cap, with a metal bushing for receiving a light standard. The metal bushing includes provisions for appropriately grounding the light fixture secured to the light standard. Thus, the apparatus fully conforms to the National Electric Code. Stabilizers are used to help stabilize the cylindrical element beneath the surface of the ground. Below ground, the bottom of the light standard is cut at an angle for conveniently receiving metal or PVC conduit.

The '877 Patent discloses several different embodiments for various use environments, including a fixed base to be secured to concrete or other flat surface. Included among the various embodiments are different elements for providing the grounding elements for the light fixture to be secured to the light standard.

The '877 apparatus does not specifically direct itself to the problem of retrofitting a plastic or nonconductive light standard to existing underground wiring, and the like. Neither does it address itself to the use of a plastic bushing to which a light fixture may be secured with provisions for grounding the light fixture.

One of the problems of the prior art metal bushings is that the bushing may corrode or oxidize in time. The corrosion problem is alleviated by use of noncorrosive grounding elements within the nonconductive bushing on threads of cap.

The apparatus of the present invention directs itself to the use of a plastic, nonconductive light standard, with an integral thread nonconductive bushing, and with provisions for the grounding of a light fixture or other electrical element to the light standard apparatus in utilizing noncorrosive grounding elements with new on pre-existing underground wiring.

SUMMARY OF THE INVENTION

The invention described and claimed herein comprises light standard apparatus which utilizes three elements, the first of which is a base element which may be secured to an existing pad of some type or may be supported directly on the ground, and over existing underground wiring. The second element is a vertically extending post which is secured to the base. The third element is a cap which is secured to the post and which includes integral threads or a plastic, nonconductive, threaded bushing for receiving a light fixture or another outdoor electrical element.

Provisions are included for grounding the light fixture or electrical element through the threaded or plastic bushing to wiring within the post in full compliance with the National Electric Code.

For securing the base to either an existing pad or the earth, different securing elements are used, and different embodiments of the base are illustrated for use with different types of securing elements.

One type of securing element to be used when the base is disposed on the ground is an earth anchor fabricated in two parts, including a shaft and an anchor element at the bottom of the shaft.

Among the objects of the present invention are the following:

To provide new and useful light standard apparatus;

To provide new and useful light standard apparatus usable for retrofitting with pre-existing or new underground wiring;

To provide new and useful nonconductive light standard apparatus with grounding elements for grounding light fixtures or other elements secured thereto;

To provide new and useful earth anchor apparatus for anchoring a light standard to the earth; and To provide new and useful noncorrosive grounding elements for grounding light fixtures to electrical wiring.

BRIEF DESCRIPTION OF THE DRAWING

FIG. 4 is an exploded perspective view in partial section of a portion of the apparatus of the present invention.

FIG. 5 is a view in partial section of the apparatus of FIG. 4 sequentially following FIG. 4.

FIG. 6 is a view in partial section sequentially following FIGS. 4 and 5.

FIG. 7A is a view in partial section illustrating an alternate embodiment of the apparatus of the present invention.

FIG. 7B is a view in partial section illustrating another alternate embodiment of the present invention.

FIG. 8 is a view in partial section taken generally along 8—8 of FIG. 1.

FIG. 9 is a view taken generally along line 9—9 of FIG. 8.

FIG. 10 is a perspective view of an alternate embodiment of the apparatus of the present invention.

FIG. 11 is a view in partial section taken generally along line 11—11 of FIG. 10.

FIG. 12 is a view taken generally along line 12—12 of FIG. 11.

FIG. 13 is a bottom view of the apparatus of FIG. 12.

DESCRIPTION OF THE PREFERRED EMBODIMENT

Figure 1:
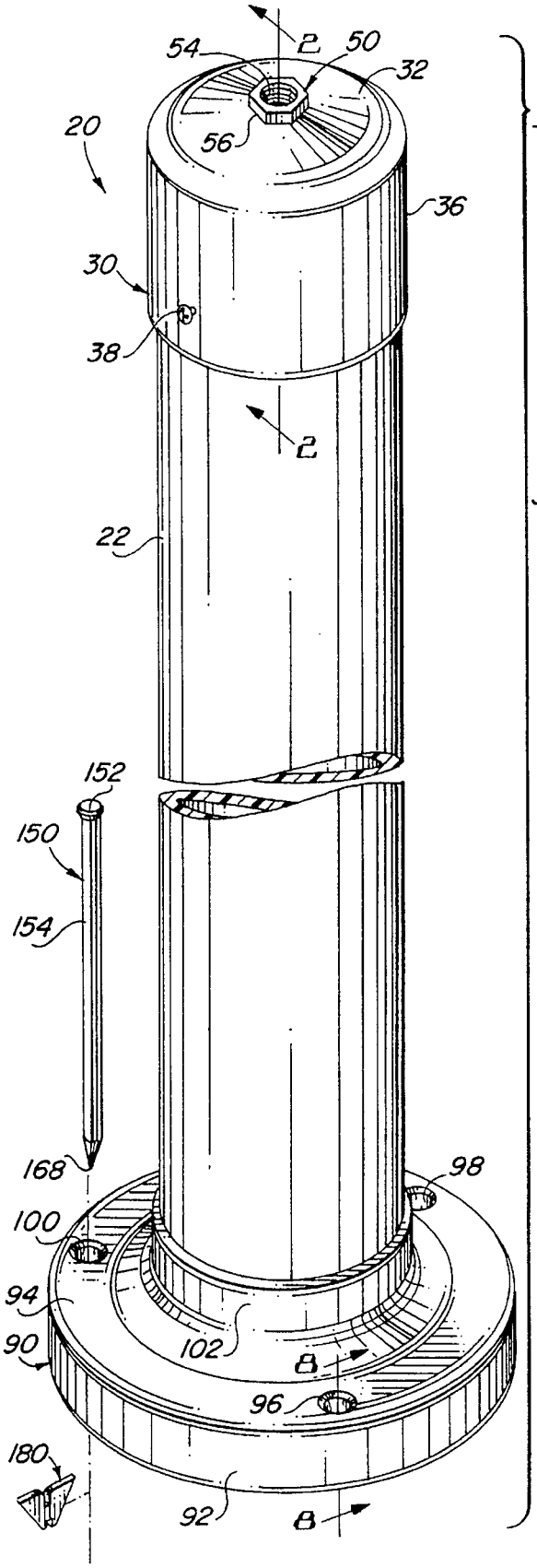
FIG. 1 is a perspective view of the apparatus of the present invention.

FIG. 1 is a perspective view of light standard apparatus 20 of the present invention. The light standard apparatus 20 includes a post 22 to which is secured a cap 30. The cap 30 receives a light fixture or other appropriate electrical element, as will be discussed below. The post 22 is in turn secured to a base 90, which supports the post 22. The base 90 may be disposed on the top of the ground and anchored or secured thereto by means of a plurality of anchor elements or stakes 150. Each stake 150 includes a head 152 at the top of a shank 154. A stabilizer 180 is secured to the lower portion of the shank 154 to help stabilize the stake 150 in the earth.

Figure 2:
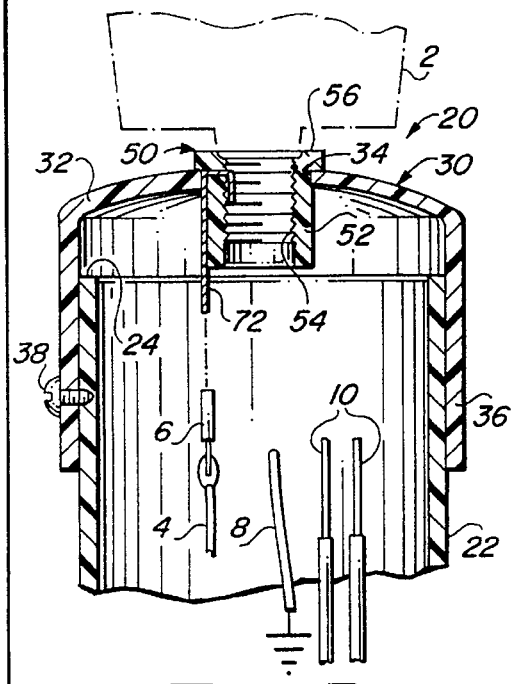
FIG. 2 is a view in partial section taken generally along line 2—2 of FIG. 1.

FIG. 2 is a view in partial section through the upper portion of the post 22 and showing the cap 30 secured thereto. The cap 32 includes an aperture 34 in which is disposed a bushing 50. The bushing 50 is nonconductive, as is the post 22, the cap 30, and the base 90. A noncorrosive element 70 (see FIG. 3) is secured to the bushing 50 for appropriately grounding a fixture 2, shown in dash dot line in FIG. 2, to appropriate electrical ground elements, such as element 4, 6 and 8. The ground conductor 8 is shown extending upwardly through the base 90 and the post 22, along with a conductor pair 10. For the following discussion, reference will primarily be made to FIGS. 1, 2, and 3. Other Figs. will be references as appropriate.

The post 22 is, as indicated above, made of nonconductive material and comprises a cylindrical element of an appropriate height. The post 22 includes a top 24 and a bottom 26, best shown in FIG. 8.

The cap 30 includes a dome or top portion 32 through which extends a central aperture 34. Extending downwardly from the outer portion of the dome or top portion 32 is a downwardly extending rim or skirt 36. The cap, like the post 22, is made of nonconductive material. A screw 38 is used to removably secure the cap 30 to the post 22.

Extending into the aperture 34 is a bushing 50. The bushing 50, as indicated above, is also made of nonconductive material.

Figure 3:
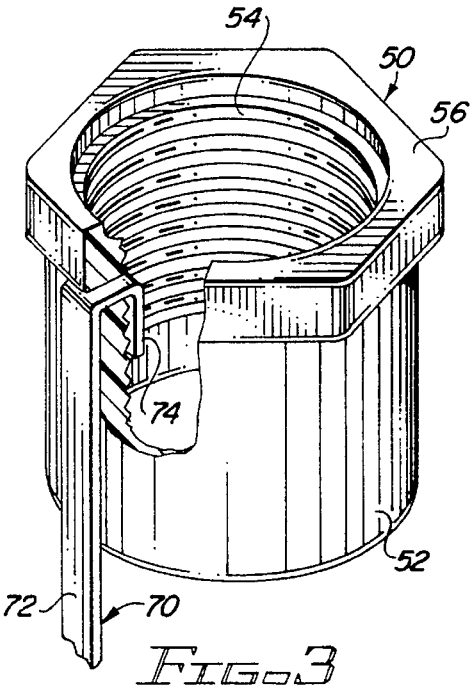
FIG. 3 is a perspective view, partially cut away, of a portion of the apparatus of the present invention.

The bushing 50 includes a cylindrical portion 52 extending downwardly from a top flange 56. The flange 56 extends radially outwardly from the cylindrical portion 52 and preferably includes a hex configuration, as best shown in FIGS. 1 and 3. The purpose of the hexagonal configuration is to receive a wrench to hold the bushing in place while a light fixture or other appropriate electrical element is secured to the bushing 50. For purposes of securing a fixture, such as the fixture 2 shown in dash dot line is FIG. 2, to the bushing 50, the bushing includes internal threads 54.

The fixture 2 is representative of a typical electrical element desired to be connected to the post or standard apparatus 20. The fixture 2 typically includes an externally threaded portion which matingly engages the internal threads 54 of the bushing 50. The electrical fixture 2, including the externally threaded connective portion, is normally conductive, or the frame, etc., including the connective portion, is normally conductive. Hence the need for grounding.

FIG. 4 is an exploded lower perspective view of the bushing 50 with the ground strap 70 shown spaced apart from the bushing 50. FIG. 5 is a view in partial section showing the bushing 50 secured to the top or dome 32 of the cap 30, with the ground strap 70 in place secured to the bushing 50 and to the cap 30. FIG. 6 is a side view in partial section illustrating the securing of the ground strap 70 within the bushing 50. FIG. 6 sequentially follows FIG. 5. For the following discussion, reference will primarily be made to FIGS. 4, 5, and 6. Reference may also be made to FIGS. 1, 2, and 3.

As indicated above, the bushing 50 includes a cylindrical portion 52 extending downwardly from a radially outwardly extending and hexagonally configured top flange 56. Within the bushing 50 are internal threads 54. An aperture 58 extends through the cylindrical portion 52 at the juncture of the cylindrical portion 52 with the top flange 56. The aperture 58 is of a generally rectangular configuration for receiving the top or upper portion of the ground strap 70.

The ground strap 70 includes an upper flat portion 72 and a downwardly extending round portion 76. The ground strap 70 is preferably made of copper or brass and is, of course, electrically conductive and noncorrosive.

The top or upper flat portion 72 includes a 90 degree bend. The 90 degree bend divides the flat portion 72 into two portions, an external portion and an internal portion. The internal portion comprises an inside conductor tab portion 74, while the external portion 72 continues downwardly to the round portion 76.

For assembling the ground strap 70 to the bushing 50 and the cap 30, the inside connector portion 74 is inserted through the aperture 58. This may be understood from FIG. 4 and is illustrated in FIG. 5. The inside portion 74 is then bent downwardly to be disposed against the internal threads 54, as shown in FIG. 6. Since the flat portion 54 is relatively thin, the bushing 50 with the ground strap 70 secured there to, is inserted through the aperture or hole 34 in the top of the dome 32 of the cap 30. The press fit required to force the cylindrical portion 52 and the portions 72 and 76 of the ground strap 70 through the hole 34 helps to secure the bushing 50 to the cap 30 with glue. This is as shown in FIGS. 5 and 6. The ground strap 70 is accordingly locked to both the cap 30 and the bushing 50.

A ground wire or conductor 8 within the post 22 may be appropriately secured to the round portion 76 of the ground strap 70 in conventional manner, using wire nuts, well known and understood in the art.

An alternative to the use of the round portion 76 is illustrated in FIG. 2. In FIG. 2, the flat portion 72 is extended downwardly and is used as a spade terminal to which the ground wire 4 may be appropriately connected through a spade connector 6. The spade connector 6 is appropriately secured to the ground conductor 4. The ground conductor 4 then may be connected to a ground wire 8 using the conventional wire nuts, as discussed above. The ground wire 8 is shown along with the conductor pair 10. The conductor pair 10 includes a "hot" conductor and a neutral conductor, as is well known and understood.

Another alternative is to simply drill a hole in the flat portion 72 of the ground strap and rivet a connector directly to the flat portion of the ground strap 72. The connector then includes a wire portion to which a ground conductor may be secured using wire nuts. Such is shown in the '877 patent, referenced above.

FIG. 7A is a view in partial section of an alternate embodiment of the present invention. The alternate embodiment comprises light post apparatus 210, of which a portion of a cap 212 is shown in FIG. 7A. The cap 212 includes a center aperture 214, and a bushing 220 is disposed in the aperture 3214. The cap 212 and the bushing 220, like the cap 30 and the bushing 50, are nonconductive and noncorrosive.

The bushing 220 includes a top flange 222 which extends outwardly from a lower cylindrical portion 224 of the bushing. The top flange 222 is shown disposed on the top surface of the cap 212 and it extends radially outwardly from the aperture or opening 214 in the cap 212.

A threaded bore 226 extends through the bushing 220. The cylindrical portion 224 of the bushing 220 terminates in a bottom surface 228. The bottom surface 228 is, of course, remote from the top flange 222.

A ground assembly 230 is shown within the threaded bore 226 and secured to the bushing 220 at the lower portion of the cylinder 224. The ground assembly 230 includes a ground strap 232 which extends upwardly within the threaded bore 226 from a connector 236. A fastener 234 extends through the ground strap 232 and the connector 236 to secure both the connector and the ground strap 232 to the bushing 220.

The ground strap 232 is generally in an "S" configuration within the bore 226. The elongated curvature of the strap 232 insures that a positive electrical connection will be made between the strap 232 and an electrical element secured to the bushing 220 and its post. See FIG. 7A.

Extending downwardly from the connector 236 is a pigtail or ground lead 238. A ground wire, such as the wire or conductor 8 of FIG. 2, may be appropriately connected to the pigtail or lead 238 for the appropriate grounding purposes.

The ground strap 232 is preferably made of appropriate material, such as hardened copper or beryllium copper or the like. Preferably, all of the ground straps are made of such material, or the like, which is noncorrosive.

The strap may also be bent into a rounded configuration axially so as to provide a maximum surface contact with an electrical element or unit inserted into the threaded bore 226.

The inherent springiness of the strap 232, with its curved configuration or convex outer surface which will make contact with the interior bore of the connector element, will provide a substantial and continuous electrical contact for grounding purposes.

FIG. 7B discloses another alternate embodiment of the apparatus of the present invention, comprising a cap 250 to which is secured a ground strap 258.

The cap 250 includes a dome portion 251 and a skirt portion 253 extending downwardly from the dome 251. Extending through the dome 251, and appropriately centered with respect thereto, is a threaded aperture 252. The aperture 252 is integral with the dome 251 and the cap 250. Thus, a separate bushing, such as disclosed in the other embodiments discussed above, is not necessary.

Adjacent to the aperture 252 is a connector 254. A ground strap 258 is secured to the connector 254.

The ground strap 258 is secured to the dome 251 adjacent to the aperture 252 by an appropriate fastener 256. The ground strap 258 is, of course, conductive, and it extends towards the aperture 252. The ground strap 258 preferably, but not necessarily, extends generally radially inwardly relative to the threaded aperture 252 so as to make a positive contact with an electrical unit or element which is threadedly secured to the cap 250 through the aperture 252.

The ground strap 258 is appropriately secured to the connector 254, and the connector 254 is secured to the dome 251 by a an appropriate fastener 256. Extending downwardly from the connector 254 is a pigtail lead 260. The lead 260 is appropriately secured to a ground conductor, such as the conductor 8, discussed above.

The cap 250 is, of course, appropriately secured to the post, such as also discussed above. If desired or necessary, the thickness of the dome 251 of the cap 250 may be increased to provide additional threads for receiving the electrical fixture (not shown, but see FIG. 2).

The ground strap 258 is preferably made of appropriate conductive material, such as copper or beryllium copper, or the like.

As an electrical fixture is threaded into the aperture 252, the fixture makes electrical contact with the ground strap 258, thus providing a ground for the fixture.

FIG. 8 is a view in partial section taken through the lower portion of the post 22 and showing the post 22 secured to the base 90. FIG. 9 is a top view of the base 90, and is taken generally along line 9—9 of FIG. 8. For the following discussion, reference will be primarily be made to FIGS. 8, 9, and 1.

The base 90 includes a cylindrical portion 92 which is adapted to be disposed on a surface, such as a slab, or the like. It may also be disposed on the earth, and appropriately anchored therein, as will be discussed below.

Extending generally inwardly from the top or upper portion of the cylindrical portion 92 is a generally horizontally extending portion 94. The portion 94 extends radially inwardly and then slopes upwardly to a central cup portion 102 which receives the lower portion of the post 22. The bottom 26 of the post 22 is shown disposed within the central cup portion 102 in FIG. 8.

Three integral fastener sleeve elements 96, 98, and 100 are shown extending downwardly through the generally horizontal portion 94 of the base 90. The integral fastener sleeve element 94, 96, and 98 are used in conjunction with fastener elements to secure the base 90, and accordingly the post 22, on a surface, such as a slab, the earth, or the like. In FIG. 8, the top or upper portion of a stake 150 is shown in dash dot line extending through the fastener sleeve 96.

FIG. 10 is a perspective view of the alternate embodiment base 120 with the lower portion of a post 22 disposed therein. FIG. 11 is a view and partial section taken through a portion of the base 120 and generally along line 11—11 thereof. FIG. 12 is a top view of a portion of the base 120, taken generally along line 12—12 of FIG. 11. FIG. 13 is a bottom view of the portion of the base 120 shown in FIG. 12. For the following discussion of the base 120, reference will primarily be made to FIGS. 10, 11, 12, and 13.

The alternate embodiment base 120 includes a relatively short cylindrical portion 122, which corresponds to the cylindrical portion 92 of the base 90. The base 120 includes a generally horizontally extending portion 124 secured to the upper portion of the cylinder 122. The horizontal portion 124 extends radially inwardly from the cylindrical portion 122 and terminates in a central cup portion 132. The cup portion 132 corresponds to the cup portion 102 of the base 90.

For fastening the base 120 to a surface, such as a slab, or the like, the-base 120 includes three recesses which extend radially inwardly from the cylindrical portion 122. The recesses include a recess 126, a recess 128, and a recess 130. The recesses are integral with the cylindrical portion 122 and the horizontal or top portion 124 of the base 120.

In FIG. 11, a bolt 16 is shown in dash dot line disposed in the recess 126 and extending through a slab 14, which may be concrete, wood, etc. The base 120 is accordingly bolted to the slab 14.

In FIG. 12, a top view of the recess 126 is shown with the bolt 16, including its washer, disposed in the recess 126 in dash dot line. The washer for the bolt 16, as well as the head of the bolt 16, is shown in relation to the recess 126 and to the adjacent portion of the horizontal or top portion 124. A portion of the post 22 is shown in the cup 132 in FIG. 12.

When the light stand apparatus 20 is disposed directly on the earth, or on the surface of the earth, an earth anchor 140 such as the stake 150 and a stabilizer 180, is used. The term "earth" is used instead of the term "ground" herein so as to prevent confusion between the use of "ground" in the electrical sense and in the "earth" sense. What is referred to herein as an earth anchor is typically called a ground anchor. However, since "ground" is used in the electrical sense above, "earth" will be used in conjunction with the anchor apparatus 140, which includes the stake 150 and the stabilizer 180.

Figures 14, 15, 16, 17, 18, 19, 20, 21, 22, 23:
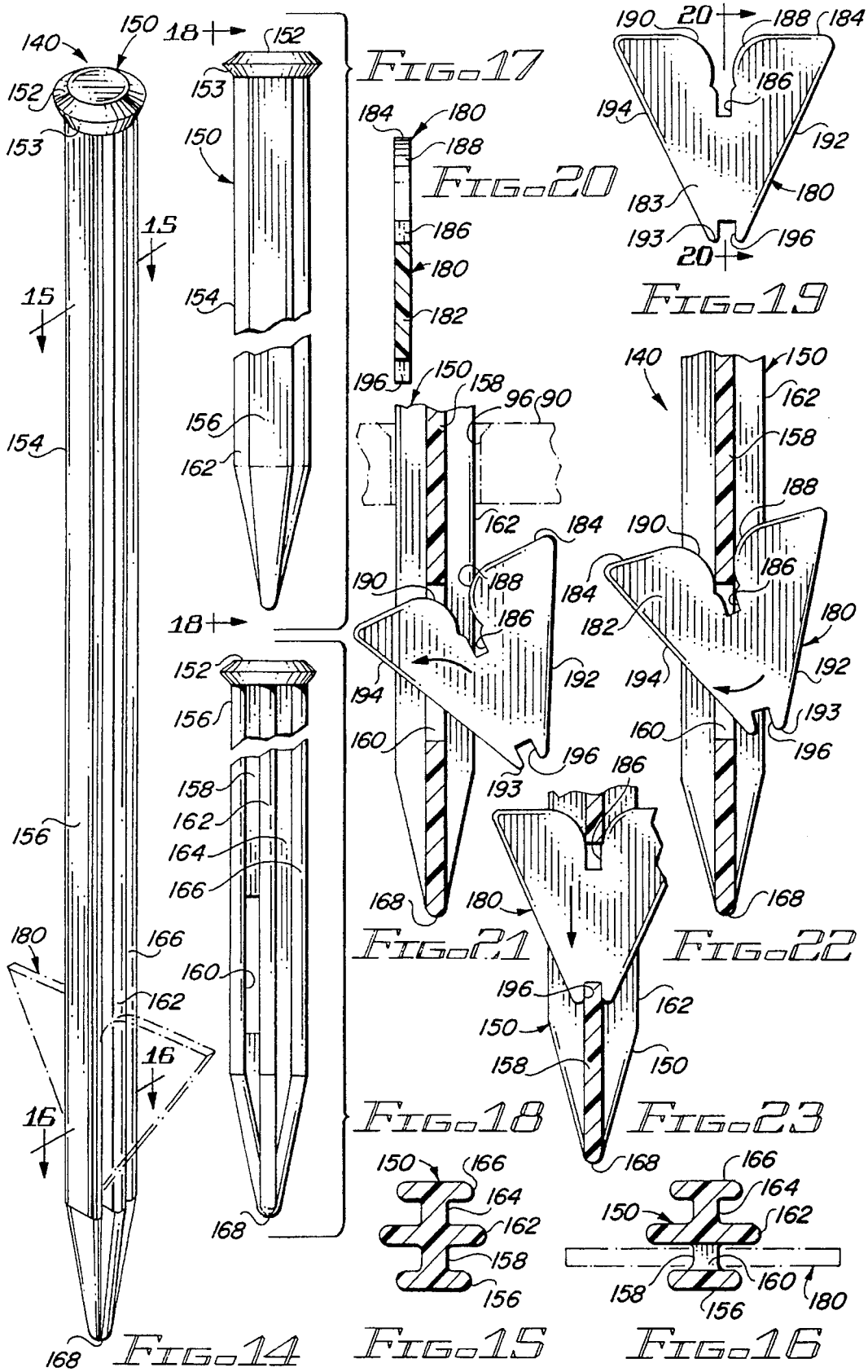
FIG. 14 is a perspective view of a portion of the apparatus of the present invention.
FIG. 15 is a view in partial section taken generally along line 15—15 of FIG. 14.
FIG. 16 is a view in partial section taken generally along line 16—16 of FIG. 14.
FIG. 17 is a side view of the apparatus of FIG. 14.
FIG. 18 is a view taken generally along line 18—18 of FIG. 17.
FIG. 19 is a plan view of a portion of the apparatus of FIG. 14.
FIG. 20 is a view in partial section taken generally along 20—20 of FIG. 19.
FIGS. 21, 22, and 23 are sequential views illustrating the assembly of the apparatus of FIG. 14.

FIG. 14 comprises a perspective view of the stake 150 showing the stabilizer 180 in dash dot line secured thereto. FIG. 15 is a view in partial section through the upper portion of the stake 150 taken generally along line 15—15 of FIG. 14.

FIG. 16 is a view in partial section taken through the lower portion of the stake 150, and generally along line 16—16 of FIG. 14. The stabilizer 180 is shown in dash dot line in FIG. 16.

FIG. 17 is a front of the stake 150, and FIG. 18 is a side view of the stake 150. FIG. 18 is taken generally along line 18—18 of FIG. 17.

FIG. 19 is a front or plan view of the stabilizer 180, and FIG. 20 is a view in partial section through the stabilizer 180, taken generally along line 20—20 of FIG. 19.

For the following discussion of the anchor apparatus 140 and its component stake 150 and stabilizer 180, reference will primarily be made to FIGS. 14, 15, 16, 17, 18, 19, and 20.

The stake 150 includes a head 152 secured to the top of a shank 154. The head 152 includes a bottom tapered portion 153 which matingly engages the upper tapered portion of the sleeve fastener elements 96, 98, and 100. The junctures of the mating tapers is best shown in FIG. 8.

The shank 154 includes three ribs, spaced apart by webs. The ribs include an outer rib 56, a middle rib 162, and a second outer rib 166. The middle rib 162 extends outwardly a greater distance than do the outer ribs 156 and 166. A web 158 is disposed between the ribs 156 and 162, and a web 164 is disposed between the ribs 162 and 166.

At the lower or bottom portion of the shank 154, the ribs taper together and terminate in a bottom point 168.

Extending through the web 158 at the lower portion of the shank 154, and spaced apart upwardly from the bottom point 168 and it's adjacent taper, is a slot 160. The slot 160 receives the stabilizer 180, as will be discussed below.

The stabilizer 180 comprises a flat or planar, generally triangularly configured body 182. The body 182 has a thickness which is generally the same as the thickness of the web 158, or the distance between the ribs 156 and 162.

The stabilizer 180 includes a generally flat top side 184, which comprises the base of an inverted triangle. The adjacent two sides of the triangle, which taper inwardly from the outer ends of the top side 184, comprise a pair of sides 192 and 194.

At the juncture of the sides 192 and 194, which comprises an apex 193 of the inverted triangle, is a bottom slot 196. The bottom slot 196 extends upwardly into the body 182 from the apex 193.

Extending downwardly from the top or base side 184 is a slot 186. The lower portion of the slot 186 has a generally rectangular configuration, but the upper portions of the slot 186 include a pair of curved surfaces 188 and 190. The surfaces 188 and 190 are generally mirror images of each other and they curve outwardly from the slot 186 to the adjacent portion of the side 184. The upper portion of the slot 186 accordingly widens out or tapers outwardly from the bottom of the slot.

The assembly of the stabilizer 180 to the stake 150 is illustrated in FIGS. 21, 22, and 23. The FIGS. 21, 22, and 23 are sequential illustrations showing the stabilizer 180 secured to the slot 160 of the stake 150 beneath the base 90. The base 90 is shown in FIG. 21 in dash dot line. It is obvious that the stabilizer 180 must be secured to the stake 150 after the shank 154 is put through the sleeves 96 98, and 100.

As best understood from FIG. 23, the overall height of the stabilizer 180, from the bottom apex 193 at the juncture of the sides 192 and 194, and which apex 193 in fact is cut away for the slot 196, to the top surface 184 is slightly longer than the slot 160 in the web 158. Hence, the need for the outwardly curved portions 188 and 190 of the slot 186. This may be understood from FIGS. 21, 22, and 23.

In assembling the stabilizer 180 to the stake 150, one wing of the stabilizer 180, which comprises the portion of the juncture of the sides 184 and 194, is put through the slot 160. This is as shown in FIG. 21. When the wing is put through the slot 160, the stabilizer 180 is moved upwardly until the slot 186 receives the adjacent portion of the web 158. This is illustrated in FIG. 22.

With the web 158 disposed in the lower or bottom portion of the slot 186, the bottom portion of the stabilizer 180 is moved through the slot 160 until the slot 196 of the stabilizer 180 is aligned with the web 158 beneath the slot 160. The stabilizer 180 is then moved downwardly until the stabilizer 180 beneath the slot 160 is disposed in the slot 196. This is illustrated in FIG. 23.

The downward movement of the stabilizer 180 is illustrated by the relatively large arrow on the stabilizer 180 in FIG. 23.

The dimensional tolerances are relatively tight so that a degree of force is required to install the stabilizer 180 in the stake 150. Accordingly, once the stabilizer 180 is placed in the slot 160 of the stake 150, it will remain in place as installed until a sufficient degree of force or effort is made to remove it from the stake. The removal is the reverse of the installation.

It will be noted that a bolt may be used with the base 90 of FIGS. 1, 8, and 9, and that an earth anchor may be used with the base 120 of FIGS. 10, 11, 12, and 13. Moreover, if the earth anchor 140 is used with the base 120, the stabilizer 180 may be installed in the stake 10 before assembly of the anchor 10 to the base.

While the principles of the invention have been made clear in illustrative embodiments, there will be immediately obvious to those skilled in the ark many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Light standard apparatus for supporting an electrical fixture to be connected to electrical conductors within the light standard apparatus, including a ground conductor, comprising in combination:

a nonconductive post for receiving electrical conductors, said nonconductive post including a ground conductor therein:

a nonconductive cap secured to the post;

means for securing the electrical fixture to the cap, including a nonconductive bushing; and means for grounding the electrical fixture, including a first ground portion in the bushing for providing electrical connection with the fixture, and a second ground portion connected to the first ground portion to be connected to the ground conductor in the post.

2. The apparatus of claim 1 in which the bushing is secured to the cap for receiving the electrical fixture.

3. The apparatus of claim 1 in which the bushing includes a bore having internal threads for receiving the fixture.

4. The apparatus of claim 3 in which the first ground portion includes a tab disposed against the internal threads of the bore for electrically contacting the electrical fixture.

5. The apparatus of claim 3 in which the means for grounding the conductive electrical fixture includes a ground strap extending into the bore.

6. Light standard apparatus for receiving an electrical fixture to be connected to electrical conductors including a ground conductor, comprising in combination:

a nonconductive post having a top and a bottom for receiving the electrical conductors;

a nonconductive cap secured to the post for closing the top of the post;

a nonconductive bushing secured to the cap for securing the electrical fixture to the cap;

grounding means secured to the bushing for grounding the fixture to the ground conductor;

base means secured to the bottom of the post to secure the post at a desired earth location; and means for anchoring the base means at the desired location.

7. The apparatus of claim 6 in which the base means includes means for receiving the means for anchoring the base means.

8. The apparatus of claim 7 in which the means for anchoring the base means includes a stake to be driven into the earth at the desired location.

9. The apparatus of claim 8 in which the means for anchoring the base means further includes a stabilizer securable to the stake.

10. The apparatus of claim 9 in which the means for receiving the means for anchoring the base means includes a sleeve for receiving the stake, and the stabilizer is secured to the stake below the sleeve and after the stake is received in the sleeve.

11. The apparatus of claim 10 in which the stake includes a slot for receiving the stabilizer.

12. The apparatus of claim 11 in which the stabilizer has a generally inverted triangular configuration.

* * * * *